US005984459A

United States Patent [19]

Takahashi et al.

[11] Patent Number: 5,984,459

[45] Date of Patent: Nov. 16, 1999

[54] INK-JET PRINTING HEAD AND INK-JET PRINTING APPARATUS USING SAME

[75] Inventors: Tetsushi Takahashi; Yoshinao Miyata; Shiro Yazaki, all of Nagano, Japan

[73] Assignee: Seiko Epson Corporation, Tokyo, Japan

[21] Appl. No.: 09/144,459

[22] Filed: Sep. 1, 1998

[30] Foreign Application Priority Data

| | | | |
|---|---|---|---|
| Sep. 1, 1997 | [JP] | Japan | 9-251307 |
| Oct. 14, 1997 | [JP] | Japan | 9-280677 |
| Aug. 17, 1998 | [JP] | Japan | 10-230517 |

[51] Int. Cl.[6] ..... B41J 2/045

[52] U.S. Cl. ..... 347/70; 347/68; 347/71

[58] Field of Search ..... 347/70, 71, 72, 347/10, 11, 68, 69

[56] References Cited

U.S. PATENT DOCUMENTS 5,381,171 1/1995 Hosono et al. ..... 347/72

5,856,837 1/1999 Kitahara et al. ..... 347/70

*Primary Examiner*—John Barlow

*Assistant Examiner*—Sydney O. Johnson, Jr.

*Attorney, Agent, or Firm*—Sughrue, Mion, Zinn, Macpeak & Seas, PLLC

[57] ABSTRACT

An ink-jet printing head and an ink-jet printing apparatus using the same, the ink-jet head comprising a piezoelectric element, a vibrating plate constituting a part of a pressure generating chamber communicating with a nozzle aperture, a lower electrode, a piezoelectric layer, and an upper electrode, wherein said vibrating plate in an area opposite to the vicinity of at least one end in the longitudinal direction of a piezoelectric active part which is an area in which said piezoelectric layer substantially drives said vibrating plate is convex on the reverse side to said piezoelectric element.

24 Claims, 12 Drawing Sheets

INK-JET PRINTING HEAD AND INK-JET PRINTING APPARATUS USING SAME

BACKGROUND OF THE INVENTION

1. Field of the Invention

The present invention relates to an ink-jet printing head and an ink-jet printing apparatus using same in which a vibrating plate constitutes a part of a pressure generating chamber communicating with a nozzle aperture for ejecting ink droplets, a piezoelectric element is provided via the vibrating plate and ink droplets are ejected by displacement of the piezoelectric element.

2. Description of the Related Art

For an ink-jet printing head for ejecting ink droplets from nozzle apertures wherein a vibrating plate constitutes a part of a pressure generating chamber communicating with a nozzle aperture for ejecting an ink droplet and ink in the pressure generating chamber is pressurized by deforming the vibrating plate by a piezoelectric element, there has been known a couple of types including one type in which a piezoelectric actuator in a longitudinal vibration mode which expands or contracts in the axial direction of a piezoelectric element is employed and the other type that employs a piezoelectric actuator in a flexural vibration mode.

For the former type, the volume of a pressure generating chamber can be varied by touching the end face of a piezoelectric element to a vibrating plate and a head suitable for high density printing can be manufactured. However, this type requires the use of a difficult process for cutting a piezoelectric element like the teeth of a comb with the piezoelectric element fitted to the pitch between nozzle apertures. Also, the positioning and fixing of the cut-out piezoelectric vibrator on a pressure generating chamber are required. Further, the manufacturing process is complicated.

On the other hand, for the latter, a green sheet formed of a piezoelectric material is formed in the shape of a pressure generating chamber and a piezoelectric element can be fixed on a vibrating plate in a relatively simple process in which the green sheet is burnt. However, since the flexural vibration is utilized, there would arise a problem that a large area is required and high density arrangement is difficult to achieve.

To solve the problem of the latter printing head, a method of forming a uniform piezoelectric material layer on the whole surface of a vibrating plate by a film forming technique and forming a piezoelectric element by cutting the piezoelectric material layer in a shape corresponding to a pressure generating chamber by lithography so that the cut piezoelectric material layer is independent of every pressure generating chamber is disclosed in Unexamined Japanese Patent Publication No. Hei. 5-286131.

This method is advantageous because it does not require a piezoelectric element to be stuck on a vibrating plate. Therefore, a piezoelectric element can be fixed by a precise and simple method called lithography and the piezoelectric layer can be formed so that it is thin and can be driven at high speed.

In this case, a piezoelectric element corresponding to each pressure generating chamber can be driven by providing at least an upper electrode for every pressure generating chamber with the piezoelectric material layer provided on the whole surface of the vibrating plate. However, it is desirable in view of the quantity of displacement per unit driving voltage and stress applied to the piezoelectric layer to provide in a part opposite to each pressure generating chamber and in a part crossing the outside a piezoelectric active part composed of the piezoelectric layer. Also, each upper electrode is provided in an area opposite to each pressure generating chamber, or at least a part except one end is formed within the area opposite to each pressure generating chamber.

However, when the piezoelectric active part in which an upper electrode pattern is formed on the piezoelectric layer is driven, a crack is readily made, particularly at the end of the piezoelectric active part and the piezoelectric active part may be fatally damaged.

If the end of the piezoelectric layer is designed to extend up to the peripheral wall of a pressure generating chamber, there is a problem that a crack is generated in a part opposite to the vicinity of a boundary between the pressure generating chamber and the peripheral wall.

These problems readily occur, particularly in a case where the piezoelectric material layer is formed by a film forming technique. The reason is that when the piezoelectric material layer formed by the film forming technique is very thin, the rigidity is lower, compared with that in case a piezoelectric element is stuck.

SUMMARY OF THE INVENTION

The present invention was made in view of such problems or difficulties accompanying the conventional ink-jet printing head. Therefore, an object of the present invention is to provide an ink-jet printing head and an ink-jet printing apparatus using the same capable of preventing a crack from occurring due to stress concentration and fatigue failure at the end of a piezoelectric active part and in the vicinity of a boundary between a pressure generating chamber and the peripheral wall.

An ink-jet printing head according to a first embodiment of the present invention for solving the above problems is based upon an ink-jet printing head which includes a pressure generating chamber communicating with a nozzle aperture, a vibrating plate constituting a part of the pressure generating chamber and a piezoelectric element corresponding to the pressure generating chamber, and the piezoelectric element comprising a lower electrode, a piezoelectric layer, and an upper electrode, and the vibrating plate in an area opposite to the vicinity of at least one end in the longitudinal direction of a piezoelectric active part of the piezoelectric element is convex to the pressure generating chamber.

According to such a first embodiment, no tensile stress from the vibrating plate is applied to the end of the piezoelectric active part when the piezoelectric layer that drives the vibrating plate is driven and stress concentration is reduced.

An ink-jet printing head according to a second embodiment of the present invention is based upon the ink-jet printing head according to the first embodiment and has a difference that the vibrating plate in an area opposite to the vicinity of the end of the above piezoelectric active part is convex to the pressure generating chamber when the piezoelectric element is driven and is convex to the piezoelectric element when the piezoelectric element is not driven.

According to such a second embodiment, stress concentration on the piezoelectric active part at least when the piezoelectric element is driven is avoided.

An ink-jet printing head according to a third embodiment of the present invention is based upon the ink-jet printing head according to the second embodiment and has a difference that stress in a direction in which the vibrating plate is compressed is applied to the vicinity of the surface on the side of the above piezoelectric layer of the vibrating plate in an area opposite to the vicinity of the end of the above piezoelectric active part when the piezoelectric element is driven.

According to such a third embodiment, the vibrating plate opposite to the vicinity of the end of the piezoelectric active part is compressed and no tensile stress is applied to the end of the piezoelectric active part when the piezoelectric element is driven.

An ink-jet printing head according to a fourth embodiment of the present invention is based upon the ink-jet printing head according to any of the first to third embodiments with a difference that clearance between the end of the piezoelectric active part and the peripheral wall of the pressure generating chamber outside the piezoelectric active part is set to a range 0.3 to 5 times as wide as the width of the pressure generating chamber.

According to such a fourth embodiment, no tensile stress is applied to the end of the piezoelectric active part when the piezoelectric element is driven by arranging the above end apart from the above peripheral wall by predetermined distance.

An ink-jet printing head according to a fifth embodiment of the present invention is based upon the ink-jet printing head according to any of the first to the fourth embodiments with an additional feature that the end of the piezoelectric active part is the end of the above piezoelectric layer provided to an area opposite to the above pressure generating chamber and the above lower electrode and the above upper electrode effectively exist at the end of the piezoelectric layer.

According to such a fifth embodiment, the end of the piezoelectric layer patterned in the area opposite to the pressure generating chamber is prevented from being broken and peeled.

An ink-jet printing head according to a sixth embodiment of the present invention is based upon the ink-jet printing head according to the fifth embodiment with a feature that the end of the above piezoelectric active part is the end of the piezoelectric layer and the above upper electrode patterned in an area opposite to the above pressure generating chamber.

According to such a sixth embodiment, the ends of the piezoelectric layer and the upper electrode are prevented from being broken and peeled off.

An ink-jet printing head according to a seventh embodiment of the present invention is based upon the ink-jet printing head according to any of the first to fourth embodiments and is characterized in that a piezoelectric inactive part in which a piezoelectric layer not substantially driven is continuously provided outside at least one end in the longitudinal direction of the piezoelectric active part.

According to such a seventh embodiment, the vicinity of an area opposite to a boundary between the pressure generating chamber and the peripheral wall is prevented from being broken and the lower electrode can be led to the pressure generating chamber via the piezoelectric inactive part.

An ink-jet printing head according to an eighth embodiment of the present invention is based upon the ink-jet printing head according to any of the first to fourth embodiments with a feature that a piezoelectric inactive part in which at least the width of the above piezoelectric layer is narrower than the width of the piezoelectric active part and which does not substantially drive the vibrating plate is continuously provided outside at least one end in the longitudinal direction of the piezoelectric active part even though the above piezoelectric inactive part is provided with the piezoelectric layer, the lower electrode and the upper electrode.

According to such an eighth embodiment, the vicinity of an area opposite to a boundary between the pressure generating chamber and the peripheral wall is prevented from being broken and voltage can be applied via the piezoelectric inactive part.

An ink-jet printing head according to a ninth embodiment of the present invention is based upon the ink-jet printing head according to the seventh or eighth embodiment and is characterized in that the piezoelectric inactive part is provided in at least one direction of the above piezoelectric active part in the longitudinal direction and is extended up to the peripheral wall of the above pressure generating chamber.

According to such a ninth embodiment, application to the piezoelectric active part is executed via the piezoelectric inactive part pulled outside the pressure generating chamber.

An ink-jet printing head according to a tenth embodiment of the present invention is based upon the ink-jet printing head according to any of the first to ninth embodiments with a difference that an insulating layer is formed on the upper surface of the above piezoelectric active part and a contact part which is a connection of the above upper electrode and a lead electrode is formed in a contact hole formed in the insulating layer.

According to such a tenth embodiment, voltage is applied to the piezoelectric active part via the contact part in the contact hole formed in the insulating layer.

An ink-jet printing head according to an eleventh embodiment of the present invention is based upon the ink-jet printing head according to the tenth embodiment with an additional feature that a contact part which is a connection of the upper electrode and a lead electrode is formed in an area which continues as far as the above piezoelectric inactive part on the peripheral wall of the above pressure generating chamber.

According to such an eleventh embodiment, application to the piezoelectric active part is executed via the contact part provided outside the pressure generating chamber.

An ink-jet printing head according to a twelfth embodiment of the present invention is based upon the ink-jet printing head according to any of the first to eleventh embodiments and is characterized in that the pressure generating chamber is formed in a monocrystalline silicon substrate by anisotropic etching and the above vibrating plate and the piezoelectric element are formed by film forming technique and lithography.

According to such a twelfth embodiment, the ink-jet printing head provided with high density nozzle apertures can be readily manufactured in large quantities.

An ink-jet printing apparatus according to a thirteenth embodiment of the present invention is characterized in that it is provided with the ink-jet printing head according to any of the first to twelfth embodiments.

According to such a thirteenth embodiment, the ink-jet printing apparatus in which the reliability of the head is enhanced can be realized.

DESCRIPTION OF THE PREFERRED EMBODIMENTS

The present invention will now be described in detail with reference to accompanying drawings.

First Embodiment

Figure 1:
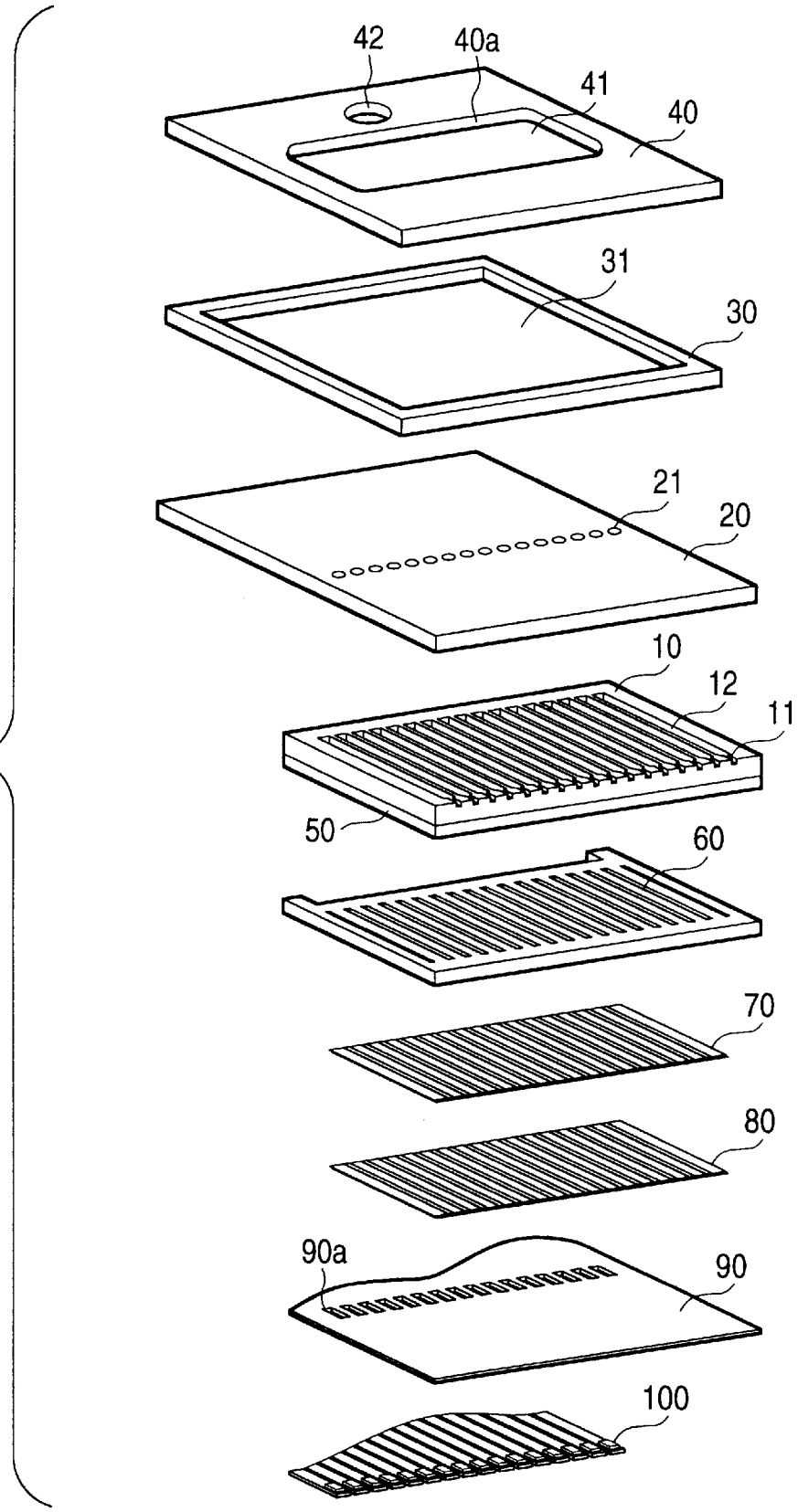
FIG. 1 is an exploded perspective view showing an ink-jet printing head according to an embodiment of the present invention.
Figure 2A:
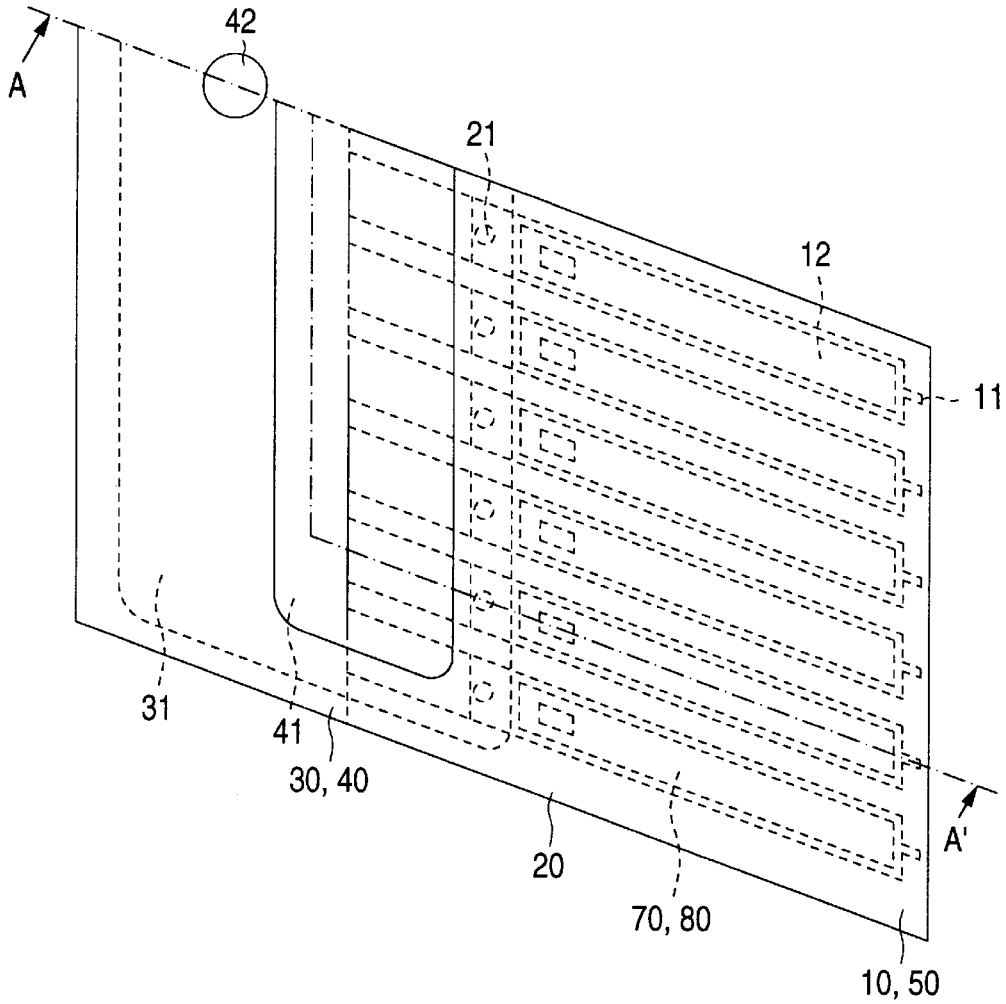
FIGS. 2A and 2B show an ink-jet printing head according to a first embodiment of the present invention and are a plan and a sectional view of FIG. 1.
Figure 2B:
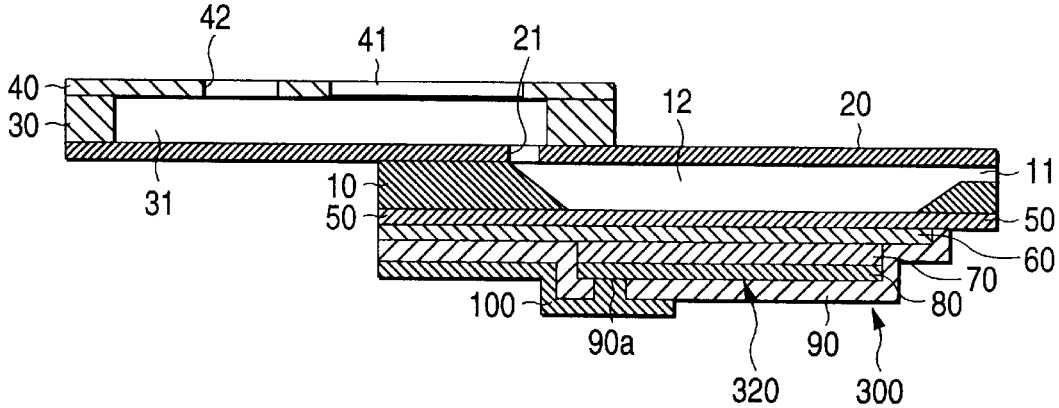

FIGS. 1 through 12 are views according to the first embodiment of the present invention. FIG. 1 is an exploded perspective view showing an ink-jet printing head according to a first embodiment of the present invention and FIGS. 2A and 2B show the sectional structure in the longitudinal direction of one pressure generating chamber shown in FIG. 1.

As shown in the above drawings, a passage forming substrate 10 is made of a monocrystalline silicon substrate with the orientation of a crystal face of (110) in this embodiment. Normally, a passage forming substrate 10 approximately 150 to 300 μm thick is used. Desirably a passage forming substrate approximately 180 to 280 μm thick, preferably approximately 220 μm thick. The reason the size is desirable is because arrangement density can be enhanced, keeping the rigidity of a partition wall between adjacent pressure generating chambers.

One face of the passage forming substrate 10 is open and an elastic film 50 with a thickness of 1 to 2 μm made of silicon dioxide formed by thermal oxidation beforehand is formed on the other surface.

In the meantime, a nozzle aperture 11 and a pressure generating chamber 12 are formed on the open face of the passage forming substrate 10 by anisotropically etching the monocrystalline silicon substrate.

The above anisotropical etching is executed such that when the monocrystalline silicon substrate is dipped in alkaline solution such as KOH and the monocrystalline silicon substrate is gradually eroded, a first crystal face (111) perpendicular to a crystal face (110) and a second crystal face (111) at an angle of approximately 70° with the first crystal face (111) and at an angle of approximately 35° with the above crystal face (110) appear and the etching rate of the crystal face (111) is approximately 1/180, compared with the etching rate of the crystal face (110). Precise working can be executed by the above anisotropic etching and the pressure generating chambers 12 can be arranged in high density.

In this embodiment, the longer side of each pressure generating chamber 12 is formed by the first crystal face (111) and the shorter side is formed by the second crystal face (111). The pressure generating chamber 12 is formed by etching the passage forming substrate 10 up to the elastic film 50. The elastic film 50 is dipped in alkaline solution for etching the monocrystalline silicon substrate.

In the meantime, each nozzle aperture 11 communicating with one end of each pressure generating chamber 12 is formed so that each nozzle aperture is narrower and shallower than each pressure generating chamber 12. That is, the nozzle aperture 11 is formed by etching (half-etching) the monocrystalline silicon substrate up to the middle in the direction of the thickness. The above half-etching is executed by adjusting etching time.

The size of the pressure generating chamber 12 which applies ink droplet ejecting pressure to ink and the size of the nozzle aperture 11 for ejecting an ink droplet are optimized according to the quantity of ejecting ink droplets, ejecting speed and an ejecting frequency. For example, if 360 ink droplets per inch are to be recorded, the nozzle aperture 11 is required to be formed precisely so that the width is several tens μm.

Each pressure generating chamber 12 and a common ink chamber 31 described later communicate via an ink supply port 21 formed in the position corresponding to one end of each pressure generating chamber 12 of a sealing plate 20 described later, and ink is supplied from the common ink chamber 31 via the ink supply communicating port 21 and distributed to each pressure generating chamber 12.

Figure 3A:
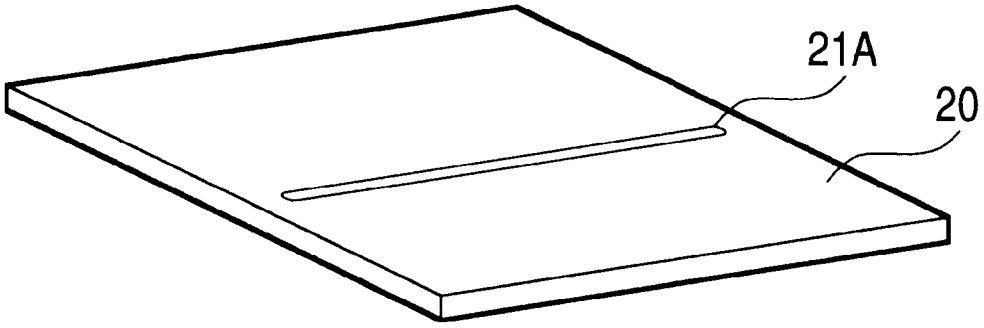
FIGS. 3A and 3B are plans showing examples in which a sealing plate shown in FIG. 1 is transformed.
Figure 3B:
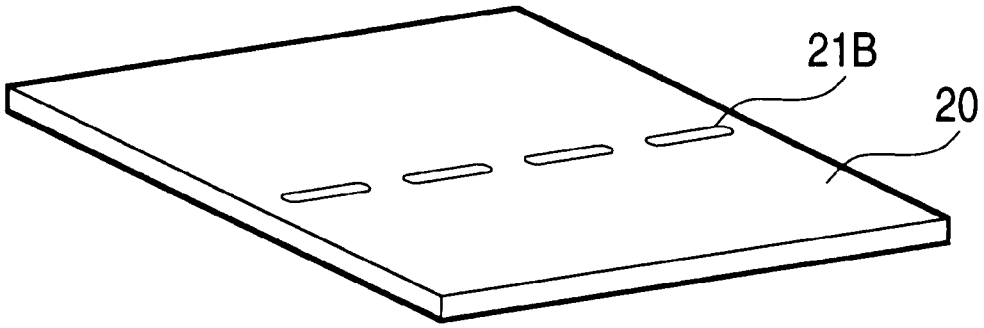

The sealing plate 20 is made of glass ceramics in which the above ink supply communicating port 21 corresponding to each pressure generating chamber 12 is made, the thickness of which is 0.1 to 1 mm for example, the coefficient of linear expansion of which is 300° C. or less and which is 2.5 to 4.5 [$\times 10^{-6}$/°C.] for example. The ink supply communicating port 21 may be also a slit 21A crossing the vicinity of the end on the side of the ink supply communicating port of each pressure generating chamber 12 or may be also plural slits 21B as shown in FIGS. 3A and 3B. One surface of the sealing plate 20 covers one surface of the passage forming substrate 10 overall and also functions as a reinforcing plate for protecting the monocrystalline silicon substrate from an impulse and external force. The other surface of the sealing plate 20 constitutes one wall surface of the common ink chamber 31.

A common ink chamber forming substrate 30 forms the peripheral wall of the common ink chamber 31 and is made by punching a stainless steel plate with appropriate thickness according to the number of nozzle apertures and an ink droplet ejecting frequency. In this embodiment, the thickness of the common ink chamber forming substrate 30 is set to 0.2 mm.

An ink chamber side plate 40 is made of a stainless steel substrate and one surface constitutes one wall surface of the common ink chamber 31. A thin wall 41 is formed by forming a concave portion 40*a* in a part of the other surface by half-etching in the ink chamber side plate 40 and further, an ink inlet 42 via which ink is supplied from the outside is formed by punching. The thin wall 41 is provided to absorb pressure generated when an ink droplet ejects toward the reverse side of the nozzle aperture 11 and prevents unnecessary positive or negative pressure from being applied to another pressure generating chamber 12 via the common ink chamber 31. In this embodiment, the thickness of the ink chamber side plate 40 is set to 0.2 mm and the thickness of the thin wall 41 which is a part of the above ink chamber side plate is set to 0.02 mm in view of rigidity required when the ink inlet 42 and external ink supply means are connected and others, however, the thickness of the ink chamber side plate 40 may be also set to 0.02 mm from the beginning to omit the formation of the thin wall 41 by half-etching.

In the meantime, a lower electrode film 60 the thickness of which is set to approximately 0.5 $\mu$m for example, a piezoelectric film 70 the thickness of which is set to approximately 1 $\mu$m for example and an upper electrode film 80 the thickness of which is set to approximately 0.1 $\mu$m for example are laminated on the elastic film 50 on the reverse side to the open face of the passage forming substrate 10 in a process described later and constitutes a piezoelectric element 300. The piezoelectric element 300 includes the lower electrode film 60, the piezoelectric film 70 and the upper electrode film 80. Generally, either electrode of the piezoelectric element 300 is made to function as a common electrode, and the other electrode and the piezoelectric film 70 are patterned every pressure generating chamber 12. A part constituted by a patterned one of either electrode and the piezoelectric film 70 in which piezoelectric distortion is generated by applying voltage to both electrodes is called a piezoelectric active part 320. In this embodiment, the lower electrode film 60 functions as a common electrode of the piezoelectric element 300 and the upper electrode film 80 functions as an individual electrode for the piezoelectric element 300. However, the common electrode and the individual electrode can be reversed. In any case, a piezoelectric active part is formed for every pressure generating chamber. The piezoelectric element 300 and a vibrating plate displaced by driving the piezoelectric element 300 are called a piezoelectric actuator. In the above example, the elastic film 50 and the lower electrode film 60 act as the vibrating plate, however, the lower electrode film may also function as the elastic film.

An insulating layer 90 for insulation from electricity is formed so that it covers at least the peripheral edge of the upper surface of the upper electrode film 80 and the side of the piezoelectric film 70. It is desirable that the insulating layer 90 is made of material which can formed by a film forming method or can be reshaped by etching, for example silicon oxide, silicon nitride and organic material. Desirably insulating layer is formed of photosensitive polyimide low in rigidity and excellent in insulation from electricity.

Referring to FIGS. 4A–4D, a process for forming the piezoelectric film 70 and others on the passage forming substrate 10 made of a monocrystalline silicon substrate will be described below.

Figure 4A:
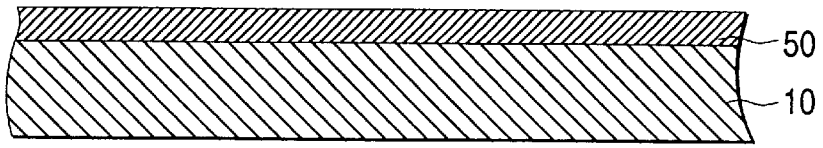
FIGS. 4A to 4D are sectional views showing a thin film manufacturing process in the first embodiment of the present invention.

As shown in FIG. 4A, first, an elastic film 50 made of silicon dioxide is formed by the thermal oxidation of a wafer of a monocrystalline silicon substrate to be the passage forming substrate 10 in a diffusing furnace heated up to approximately 1100° C.

Figure 4B:
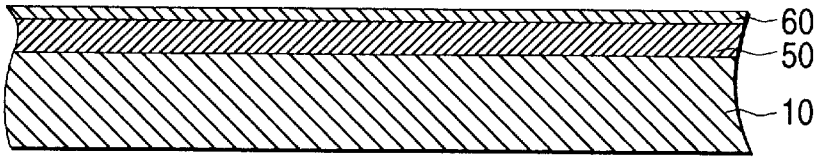

Next, as shown in FIG. 4B, a lower electrode film 60 is formed by sputtering. For the material of the lower electrode film 60, platinum Pt is suitable. The reason is that a piezoelectric film 70 described later formed by sputtering or sol-gel transformation is required to be crystallized by burning the formed piezoelectric film at the temperature of approximately 600 to 1000° C. in atmospheric air or the atmosphere of oxygen. That is, it is desirable that the material of the lower electrode film 60 is required to secure conductivity in the above atmosphere of oxygen heated up to high temperature and particularly if lead zirconate titanate (PZT) is used for the piezoelectric film 70, it is desirable that conductivity is hardly changed by diffusing PbO and Pt is suitable for the above reason.

Figure 4C:
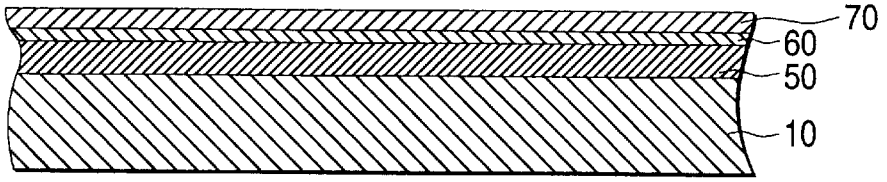

Next, as shown in FIG. 4C, the piezoelectric film 70 is formed. The piezoelectric film 70 may be also formed by sputtering, however, in this embodiment, so-called sol-gel transformation wherein so-called sol in which a metallic organic matter is dissolved and dispersed in a solvent gels by applying and drying the sol. The piezoelectric film 70 made of metallic oxide is obtained by burning the gel at high temperature. For the material of the piezoelectric film 70, PZT is suitable if it is used for an ink-jet printing head.

Figure 4D:
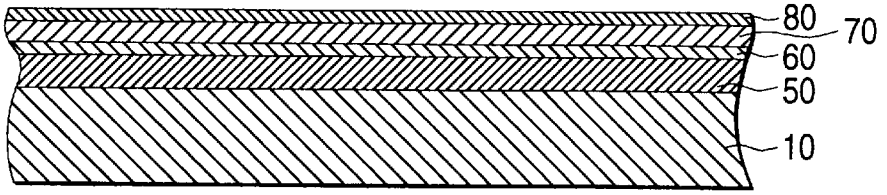

Next, as shown in FIG. 4D, an upper electrode film 80 is formed. The upper electrode film 80 only has to be made of conductive material and many metals such as Al, Au, Ni and Pt, conductive oxide and others can be used. In this embodiment, Pt is formed into a film by sputtering.

Figure 5A:
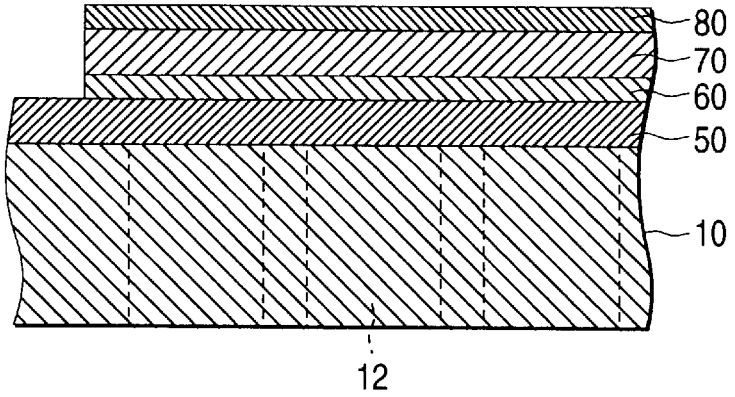
FIGS. 5A to 5C are sectional views showing the thin film manufacturing process in the first embodiment of the present invention.
Figure 5B:
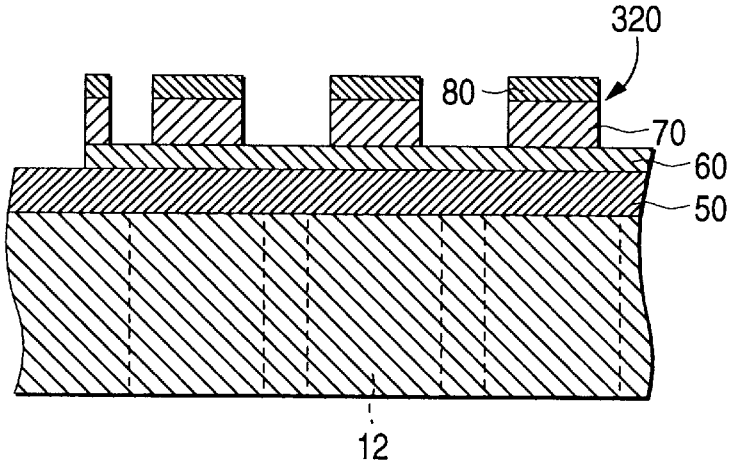
Figure 5C:
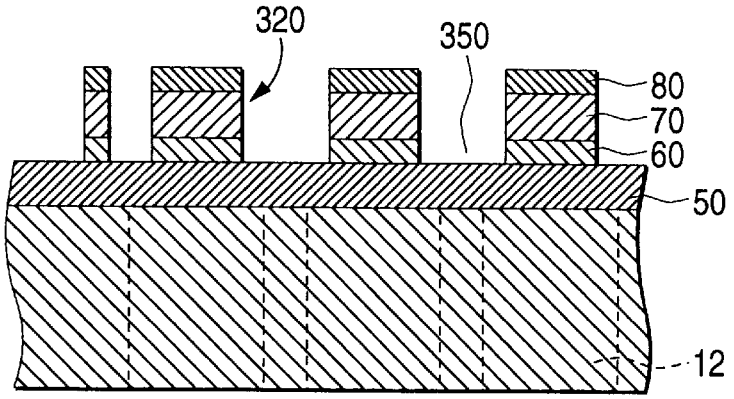

Next, as shown in FIGS. 5A–5C, the lower electrode film 60, the piezoelectric film 70 and the upper electrode film 80 are patterned.

First, as shown in FIG. 5A, the lower electrode film 60, the piezoelectric film 70 and the upper electrode film 80 are etched together according to the pattern of the lower electrode film 60. Next, as shown in FIG. 5B, only the piezoelectric film 70 and the upper electrode film 80 are etched and a piezoelectric active part 320 is patterned. Next, as shown in FIG. 5C, a lower electrode film removed part 350 is formed by removing the lower electrode film 60 which is a part of a vibrating plate on both sides of the piezoelectric active part 320 opposite to both sides in the direction of the width of each pressure generating chamber 12 shown by a broken line in FIGS. 5A–5C. The quantity of displacement by applying voltage to the piezoelectric active part 320 is increased by providing the lower electrode film removed part 350 as described above.

The lower electrode film removed part 350 may be also thinned without removing the lower electrode film 60 completely. The lower electrode film removed part 350 is formed in a part according to the arm of the piezoelectric active part 320, however, the lower electrode film removed part is not limited to the above part lower electrode film removed part may be also formed up to the outside in the longitudinal direction of both ends of the piezoelectric active part 320, for example, and may be also formed approximately over the periphery of the pressure generating chamber 12. Needless to say, the lower electrode film removed part 350 is not necessarily required to be provided.

Figure 6A:
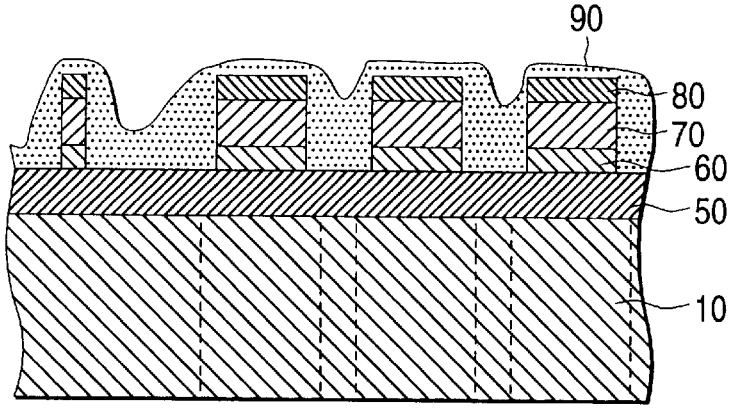
FIGS. 6A to 6C are sectional views showing the thin film manufacturing process in the first embodiment of the present invention.

As described above, after the lower electrode film 60 and others are patterned, it is desirable that the insulating layer 90 for insulation from electricity is formed so that it covers at least the edge of the upper surface of the upper electrode film 80 and the side of the piezoelectric film 70 and the lower electrode film 60 as shown in FIG. 6A.

A contact hole 90*a* exposing a part of the upper electrode film 80 to connect to a lead electrode 100 described later is formed in a part of the part covering the upper surface of the part corresponding to one end of each piezoelectric active part 320 of the insulating layer 90. A lead electrode 100 one end of which is connected to each upper electrode film 80 via the contact hole 90*a* and the other end of which is extended to a connecting terminal is formed.

Figure 6B:
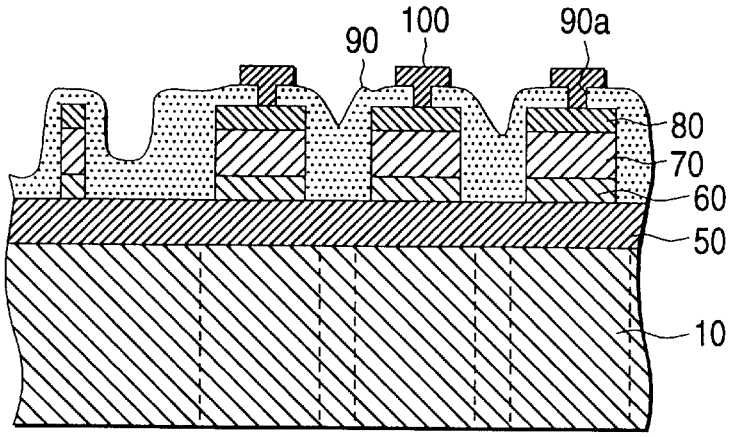
Figure 6C:
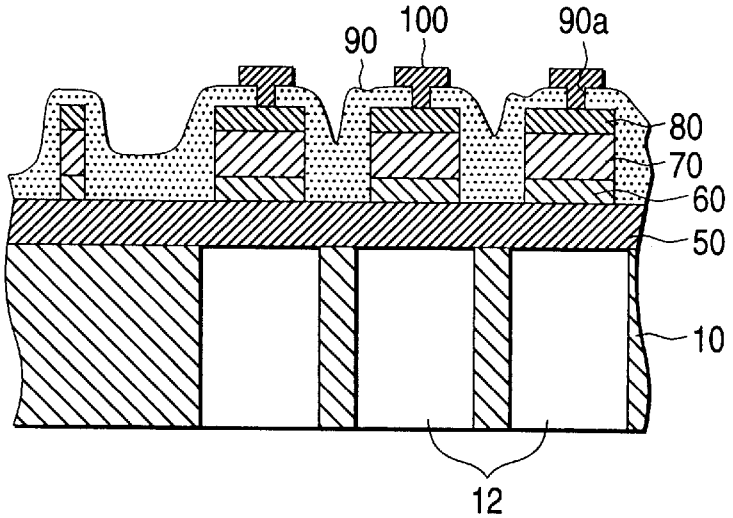

FIGS. 6A–6C shows such a process for forming the insulating layer and the lead electrode.

First, as shown in FIG. 6A, the insulating layer 90 is formed so that it covers the edge of the upper electrode film 80 and the side of the piezoelectric film 70 and the lower electrode film 60. The suitable material of the insulating layer 90 is described above, however, in this embodiment, negative photosensitive polyimide is used.

Next, as shown in FIG. 6B, the contact hole 90*a* is formed in a part corresponding to the vicinity of the end on the side of the ink supply port of each pressure generating chamber 12 by patterning the insulating layer 90. The contact hole 90*a* is provided to connect the lead electrode 100 described later and the upper electrode film 80. The contact hole 90*a* has only to be provided in a part corresponding to the piezoelectric active part 320 and for example, the contact hole may be also provided in the center and at the end on the side of a nozzle.

Next, the lead electrode 100 is formed by patterning an electric conductor after the electric conductor such as Cr—Au.

The process for forming films is described above. After films are formed as described above, the monocrystalline silicon substrate is anisotropically etched by dipping the above alkaline solution as shown in FIG. 6C and a pressure generating chamber 12 and others are formed.

In such an ink-jet printing head, multiple chips are simultaneously formed on one wafer by the above series of forming films and anisotropic etching and after the process is finished, the wafer is divided into each passage forming substrate 10 in one chip size shown in FIG. 1. The sealing plate 20, the common ink chamber forming substrate 30 and the ink chamber side plate 40 are sequentially bonded to the divided passage forming substrate 10 and integrated to be an ink-jet printing head.

In the ink-jet printing head constituted as described above, after ink is taken in from the ink inlet 42 connected to the external ink supply means not shown and the inside from the common ink chamber 31 to the nozzle aperture 11 is filled with ink, pressure in the pressure generating chamber 12 is increased and an ink droplet ejects from the nozzle aperture 11 by applying voltage between the lower electrode film 60 and the upper electrode film 80 via the lead electrode 100 according to a recording signal from an external driving circuit not shown, thus flexuously deforming the elastic film 50, the lower electrode film 60 and the piezoelectric film 70.

Figure 7A:
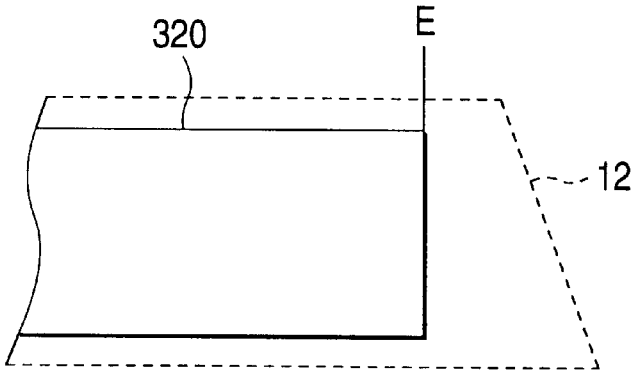
FIGS. 7A and 7B are a plan and a sectional view showing the main part of the ink-jet printing head according to the first embodiment of the present invention.
Figure 7B:
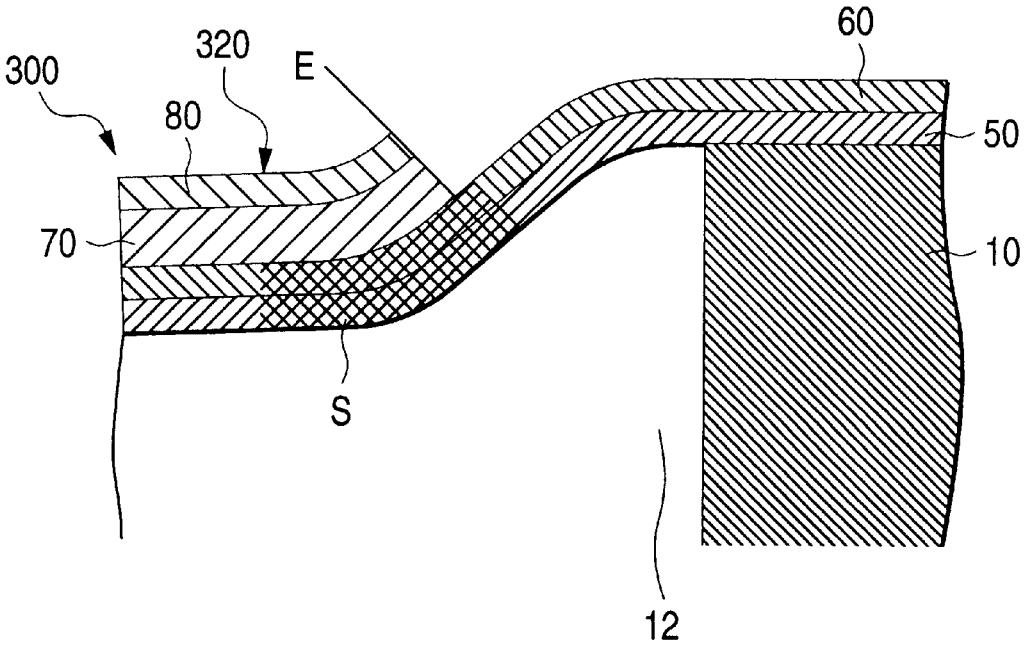

FIGS. 7A and 7B show the positional relationship between the pressure generating chamber 12 and the piezoelectric active part 320 respectively formed as described above and the enlarged section in the vicinity of the end of the pressure generating chamber 12 when the piezoelectric active part 320 is driven.

As shown in FIG. 7A, the piezoelectric active part 320 composed of the piezoelectric film 70 and the upper electrode film 80 is provided in an area opposite to the pressure generating chamber 12 linearly. The elastic film 50 and the lower electrode film 60 are deformed so that they are convex upward in the vicinity of the peripheral wall of the pressure generating chamber 12 when they are viewed from the piezoelectric active part 320 as shown in FIG. 7B. As the piezoelectric active part 320 is deformed by applying voltage, the elastic film 50 and the lower electrode film 60 are deformed in the most part of the pressure generating chamber 12 so that they are convex downward (concave). The end E of the piezoelectric active part 320 is located in a range in which the elastic film 50 and the lower electrode film 60 are concave when they are deformed as described above, that is, a range S in which the center of curvature is located on the side on which the piezoelectric film 70 is formed. This range S is a range in which the elastic film 50 is convex in a direction reverse to the side on which the piezoelectric active part 320 is provided and if the piezoelectric active part is provided under the elastic film, the end of the piezoelectric active part only has to exist in an area in which the elastic film is convex upward.

As no tensile stress is caused at the end of the piezoelectric active part 320 when the piezoelectric active part 320 is driven by forming the piezoelectric active part as described above, stress concentration in the vicinity of the peripheral wall of the pressure generating chamber 12 is reduced, and these parts and others can be prevented from being peeled or a crack and others can be prevented from being caused in the vicinity of the end of the pressure generating chamber 12. The condition of the above range S only has to be met at least when the piezoelectric active part is driven and the above effect is produced even if the elastic film is deformed in the reverse direction when the piezoelectric active part is not driven.

Figure 8:
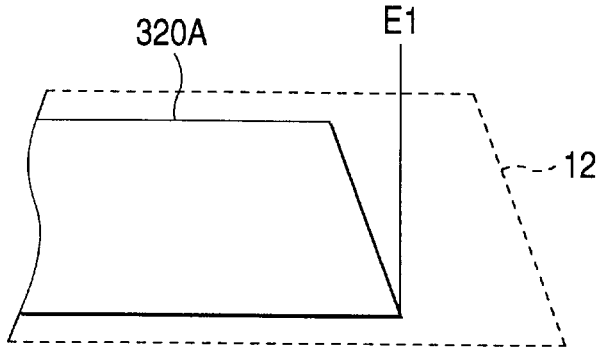
FIG. 8 is a plan showing the main part of an example in which the ink-jet printing head according to the first embodiment of the present invention is transformed.
Figure 9:
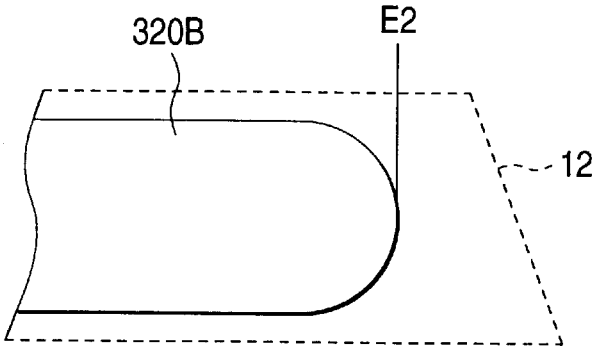
FIG. 9 is a plan showing the main part of an example in which the ink-jet printing head according to the first embodiment of the present invention is transformed.

The patterned shape of the piezoelectric active part 320 is not particularly limited in this embodiment and for example, as shown in FIG. 8, the shape at the end of a piezoelectric active part 320A may be also approximately the same as the shape of the pressure generating chamber 12. In this case, the end of the piezoelectric active part 320A is a corner E1 protruded toward the end of the pressure generating chamber 12 and the corner E1 is formed so that it is located in the above range S. Further, for example, as shown in FIG. 9, the shape at the end of a piezoelectric active part 320B may be also approximately an arc and in this case, the piezoelectric active part 320B is formed so that the end E2 in the shape of an arc is located in the above range S.

Figure 10:
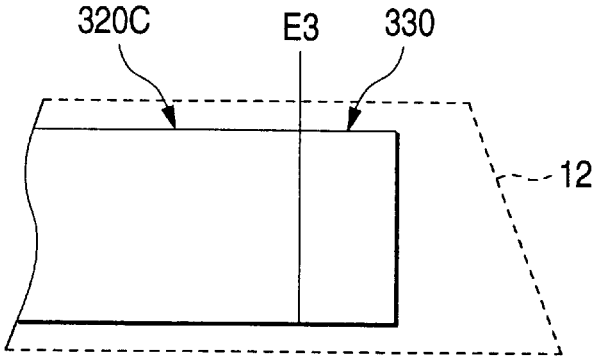
FIG. 10 is a plan showing the main part of an example in which the ink-jet printing head according to the first embodiment of the present invention is transformed.
Figure 11:
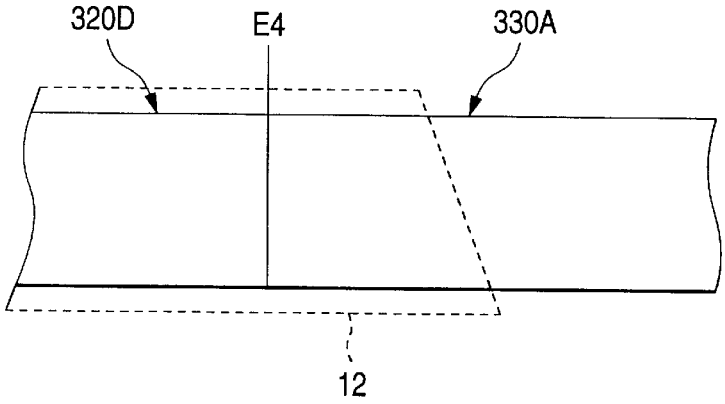
FIG. 11 is a plan showing the main part of an example in which the ink-jet printing head according to the first embodiment of the present invention is transformed.
Figure 12:
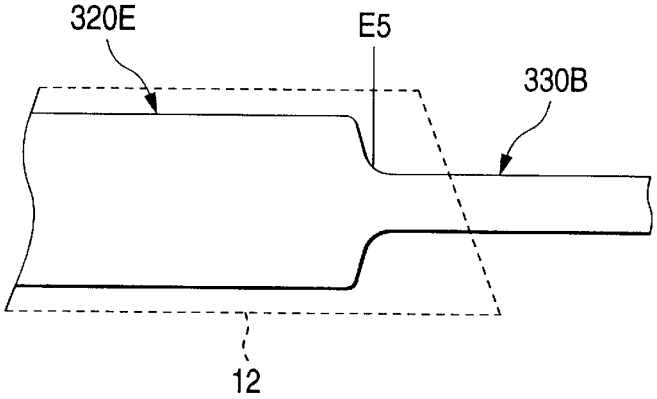
FIG. 12 is a plan showing the main part of an example in which the ink-jet printing head according to the first embodiment of the present invention is transformed.

To further effectively prevent a crack and others from being caused at the end of the piezoelectric active part 320 and in the vicinity of the end of the pressure generating chamber 12, structure shown in FIGS. 10 to 12 for example may be also adopted in addition to the structure in this embodiment.

That is, as shown in FIG. 10, a piezoelectric inactive part 330 in which the upper electrode film 80 is removed and only the piezoelectric film 70 is formed may be also formed outside the end in the longitudinal direction of a piezoelectric active part 320C so as to reduce the vibration at the end in the longitudinal direction of the piezoelectric active part 320C. As the piezoelectric inactive part 330 is not driven by applying voltage to the piezoelectric active part 320C, vibration in the vicinity of the end of the piezoelectric active part 320C is reduced, and peeling, the generation of a crack and others in this part can be effectively prevented. In this case, the end of the piezoelectric active part 320C is located at a boundary E3 with the piezoelectric inactive part 330 and the piezoelectric active part 320C is formed so that the boundary E3 is located in the above range S.

The piezoelectric inactive part 330 may be also provided outside both ends, however, for example, it may be also provided only at the end near the contact hole 90*a* which functions as the contact part with the lead electrode 100.

Also, as shown in FIG. 11, a piezoelectric inactive part 330A may be also formed outside the end in the longitudinal direction of a piezoelectric active part 320D as in the structure shown in FIG. 10 so that the piezoelectric inactive part is extended up to over the peripheral wall across the end of the pressure generating chamber 12, that is, the piezoelectric inactive part 330A crosses a boundary between an area opposite to the pressure generating chamber 12 and an area opposite to the peripheral wall. Also in this case, as described above, the piezoelectric active part 320D is formed so that a boundary E4 with the piezoelectric inactive part 330A is located in the above range S.

Vibration by applying voltage is substantially prevented at the end of the piezoelectric active part 320D and in the vicinity of the peripheral wall of the pressure generating chamber 12 by forming the piezoelectric active part as described above, and the peeling of these parts, the generation of a crack in these parts and others can be effectively prevented.

Further, generally, a crack is readily caused in the piezoelectric film 70 and others in the vicinity of a boundary between the pressure generating chamber 12 and the peripheral wall by repeated displacement, however, as the piezoelectric film 70 in this part is the piezoelectric inactive part 330A, a crack is prevented from being caused in this part.

Furthermore, as shown in FIG. 12, a piezoelectric active part 320E is extended over the peripheral wall across the end of the pressure generating chamber 12 and a piezoelectric inactive part 330B, the width of which is narrower though the piezoelectric inactive part and which is provided with the same lamination as the piezoelectric active part 320E and which is not substantially a driven part, may be also provided in an area crossing the pressure generating chamber 12 and the peripheral wall. In this case, the piezoelectric active part 320E is a substantially driven part and, a boundary E5 between the piezoelectric active part 320E and the piezoelectric inactive part 330B is formed so that the boundary is located in the above range S.

Peeling, the generation of a crack and other problems at the end of the piezoelectric active part 320E and in the vicinity of the peripheral wall of the pressure generating chamber 12 when voltage is applied can be effectively prevented by forming the piezoelectric part as described above. In the above structure, contact with the above lead electrode can be made outside the pressure generating chamber.

Second Embodiment

Figure 13:
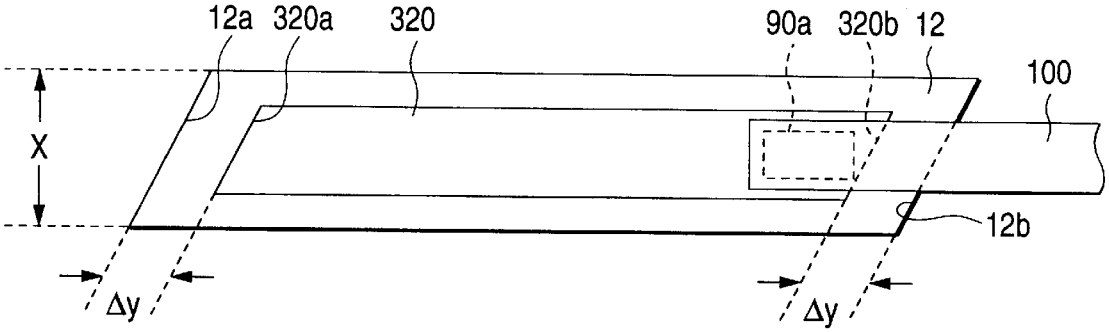
FIG. 13 is a plan showing the main part of an ink-jet printing head according to a second embodiment of the present invention.

FIG. 13 is a plan view showing the main part of an ink-jet printing head according to a second embodiment. The basic constitution in this embodiment is the same as that in the first embodiment, however, clearance Δy respectively between the shorter sides 320*a* and 320*b* at each end in the longitudinal direction of a piezoelectric active part 320 and the shorter sides 12*a* and 12*b* opposite to the above shorter sides of the peripheral wall of a pressure generating chamber 12 is set so that the clearance is in a predetermined range.

Such a predetermined range is determined based upon the following information: That is, when the value of the clearance Δy is larger than a fixed value, an elastic film 50 in an area opposite to each of the shorter sides 320*a* and 320*b* of the piezoelectric active part 320 is convex downward as in the above first embodiment, and the elastic film 50 and the piezoelectric active part 320 are prevented from being broken due to stress concentration. In the meantime, when the value of the clearance Δy exceeds a fixed value, the rigidity of the elastic film 50 is reduced, a crinkle is made in an area where the piezoelectric active part 320 does not exist in the elastic film 50 in the manufacturing process, ejecting an ink droplet becomes unstable and as the area of the piezoelectric active part 320 is reduced, performance when the piezoelectric active part is driven is deteriorated. The clearance Δy is varied depending upon the width X of the pressure generating chamber 12.

Table 1 shows the result of varying clearance Δy, applying a driving signal with the driving frequency of 14.4 kHz for an hour and examining relationship between the clearance Δy and whether the piezoelectric active part 320 is broken or not so as to acquire optimum clearance Δy. The following table 1 proves that if clearance Δy is 0.3 or more times as wide as the width X of the pressure generating chamber 12, the piezoelectric active part is not broken.

In the above range, it is verified that the elastic film 50 in an area opposite to the end of the piezoelectric active part 320 is convex downward. Therefore, as described in detail in the first embodiment, to locate the end of the piezoelectric active part 320 in an area in which the elastic film 50 is convex downward, it is verified for example, the above clearance Δy has only to be 0.3 or more times as wide as the width X of the pressure generating chamber 12.

TABLE 1

| Clearance | x0.1 | x0.2 | x0.3 | x0.4 | x0.5 | x0.7 | x0.9 |
|---|---|---|---|---|---|---|---|
| Stress breaking modulus | 10/10 | 4/10 | 0/10 | 0/10 | 0/10 | 0/10 | 0/10 |
| Evaluation | X | X | ○ | ○ | ○ | ○ | ○ |

Further, Table 2 shows the result of varying clearance Δy in a further large range and examining relationship between the clearance Δy and the rate of occurrence of a crinkle in the elastic film 50 after the passage forming substrate 10 is etched and the pressure generating chamber 12 is formed. The following table 2 shows that if clearance Δy is five or less times as wide as the width X of the pressure generating chamber 12, no crinkle is made.

TABLE 2

| Clearance | X3 | X4 | X5 | X6 | X7 | X8 |
|---|---|---|---|---|---|---|
| Rate of occurrence of crinkle | 0/10 | 0/10 | 0/10 | 3/10 | 8/10 | 10/10 |
| Evaluation | ○ | ○ | ○ | X | X | X |

Other Embodiments

The embodiments of the present invention are described above, however, the basic constitution of the ink-jet printing head according to the present invention is not limited to the above.

For example, a common ink chamber forming plate 30 may be also made of glass ceramics in addition to the above sealing plate 20, further, a thin film 41 may be also made of glass ceramics separately and the material, the structure and others may be varied freely.

In the above embodiments, the nozzle aperture is formed on the end face of the passage forming substrate 10, however, a nozzle aperture protruded in a perpendicular direction to the end face may be also formed.

Figure 14:
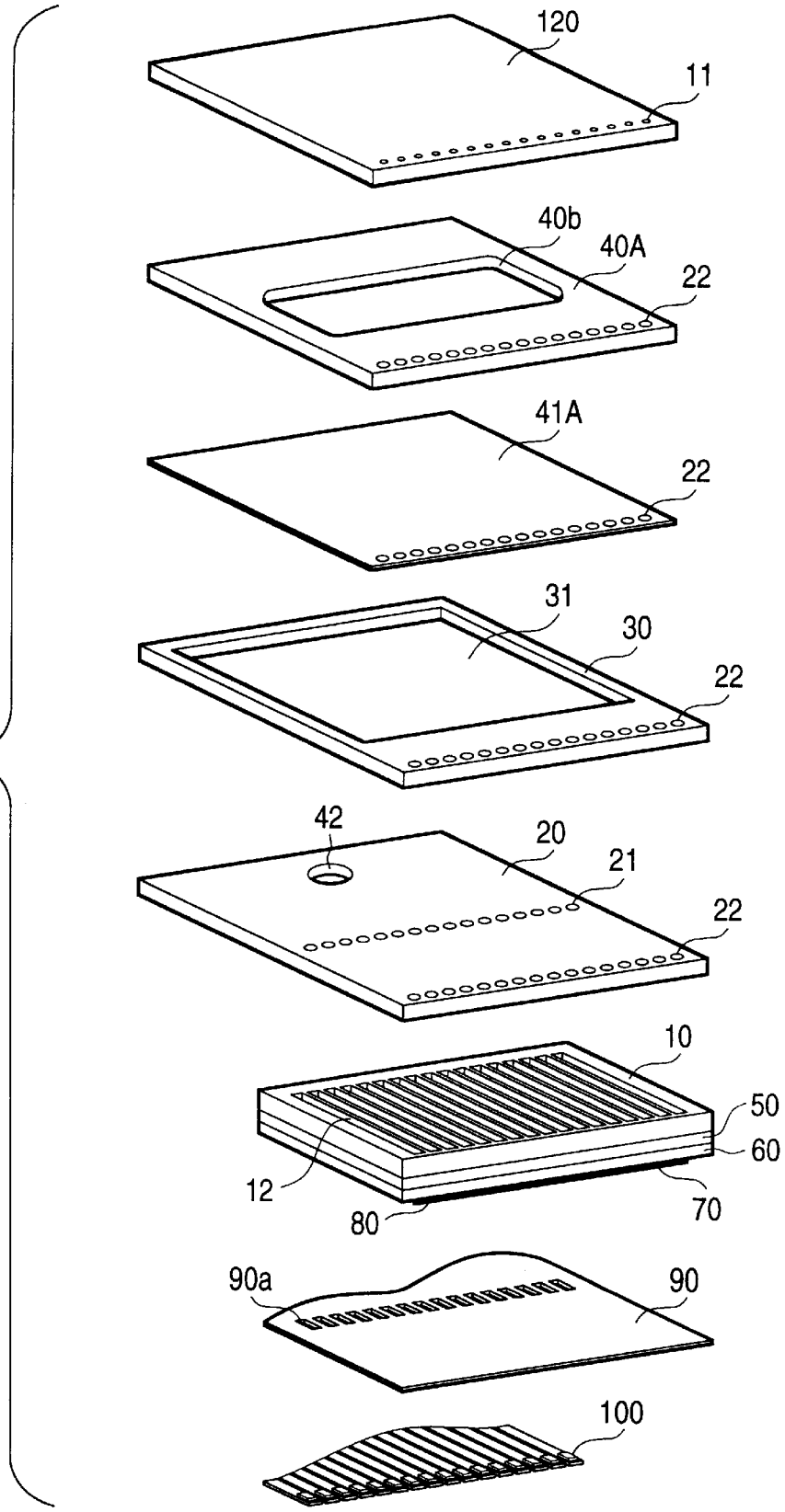
FIG. 14 is an exploded perspective view showing an ink-jet printing head according to the other embodiment of the present invention.
Figure 15:
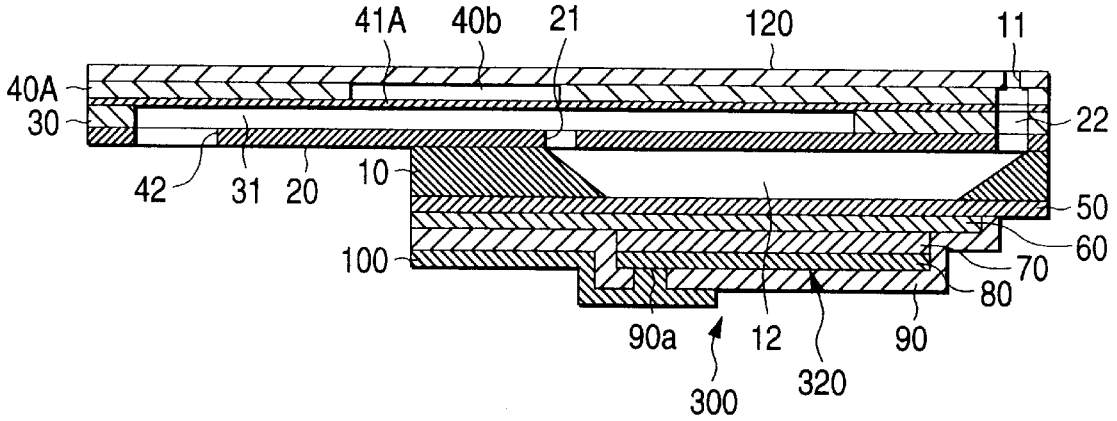
FIG. 15 is a sectional view showing the ink-jet printing head according to the other embodiment of the present invention.

FIG. 14 is an exploded perspective view showing an embodiment constituted as described above and FIG. 15 shows the section of a passage. In this embodiment, a nozzle aperture 11 is made in a nozzle substrate 120 on the reverse side to a piezoelectric element and a nozzle communicating port 22 connecting the nozzle aperture 11 and a pressure generating chamber 12 pierces the sealing plate 20, the common ink chamber forming plate 30, a thin plate 41A and an ink chamber side plate 40A.

This embodiment is basically the same as the above embodiments except in that the thin plate 41A and the ink chamber side plate 40A are formed by different members and an opening 40*b* is formed in the ink chamber side plate 40. The same reference numbers are allocated to the same member and the description is omitted.

Also in this embodiment, as in the first and second embodiments, when a vibrating plate is deformed by applying voltage, stress concentration at the end of a piezoelectric active part and in the vicinity of the peripheral wall of the pressure generating chamber is reduced and a crack and others can be prevented from being generated respectively by locating the end of the piezoelectric active part in a range in which the center of curvature is located on the side of a piezoelectric film.

Needless to say, the present invention can be also similarly applied to an ink-jet printing head of a type that a common ink chamber is formed in the passage forming substrate.

In the above embodiments, a thin film type of ink-jet printing head which can be manufactured by applying a film forming and lithographic process is described as the example, however, needless to say, the present invention is not limited to the example and the present invention can be applied to ink-jet printing heads with various structures including a type that a pressure generating chamber is formed by laminating substrates, a type that a piezoelectric film is formed by sticking a green sheet, screen printing or others and types wherein the piezoelectric film is formed by crystal growth.

Also in the above embodiments, basically a lead electrode is connected via the above contact hole 90*a,* however, the patterned shape of the lead electrode is not particularly limited.

Further, the example in which an insulating layer is provided between the piezoelectric element and the lead electrode is described above, however, the present invention is not limited to this example. An anisotropic conductive film may be also thermically welded to each upper electrode without providing the insulating layer, connected to the lead electrode or connected using various bonding techniques such as wire bonding.

As described above, the present invention can be applied to ink-jet printing heads with various structures unless they are contrary to the object of the present invention.

Figure 16:
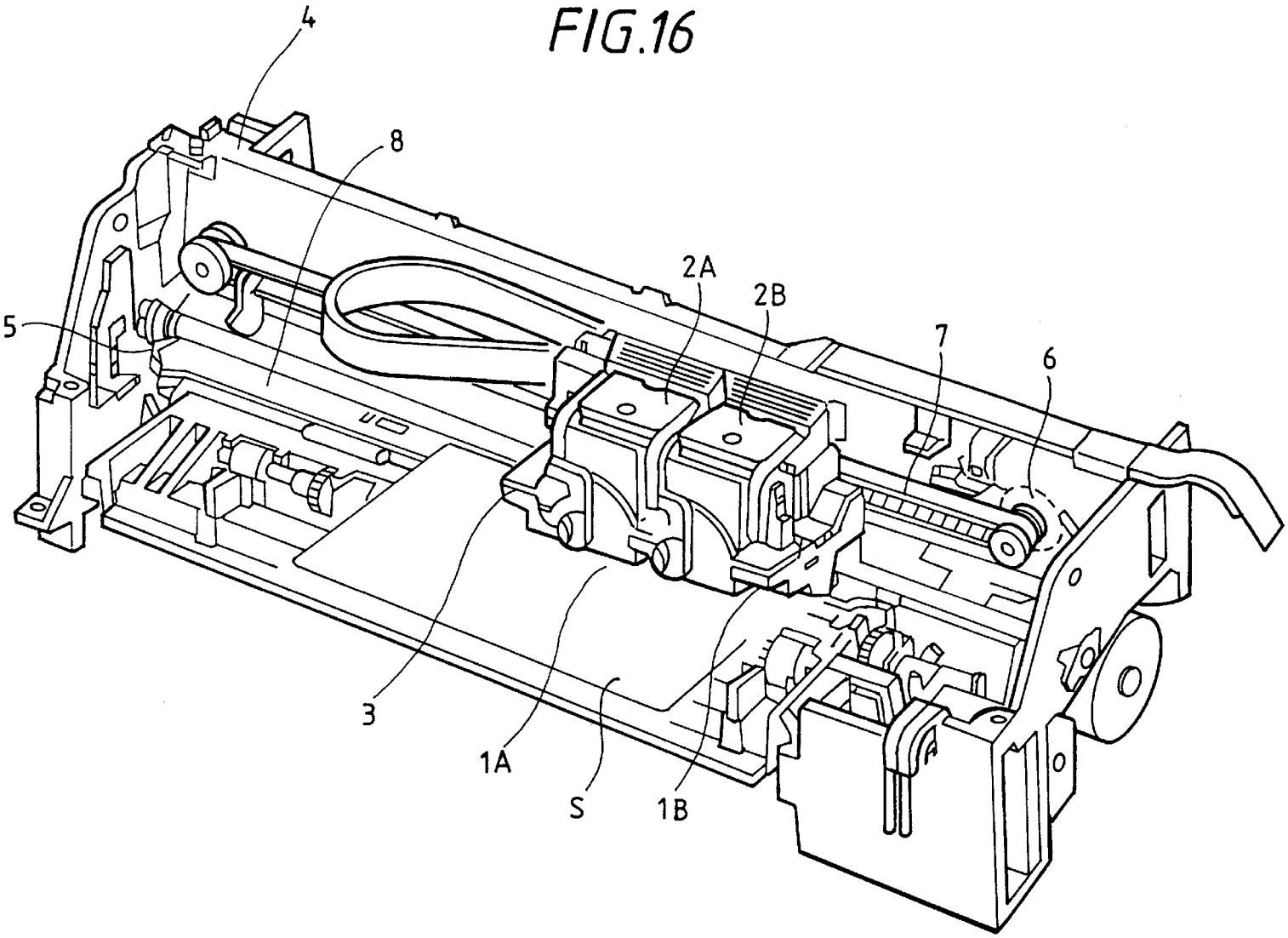
FIG. 16 is a schematic drawing showing an ink-jet printing apparatus according to an embodiment of the present invention.

The ink-jet printing heads according to these embodiments respectively constitute a part of a printing head unit provided with an ink passage communicating with an ink cartridge and others and are respectively mounted in an ink-jet printing apparatus. FIG. 16 is a schematic drawing showing an example of the ink-jet printing apparatus.

As shown in FIG. 16, each cartridge 2A and 2B constituting ink supply means is respectively provided to each printing head unit 1A and 1B provided with an ink-jet printing head so that the cartridge can be detached and a carriage 3 mounting each printing head unit 1A and 1B is provided to a carriage shaft 5 attached to the body 4 of the apparatus so that the carriage 3 can be moved freely in the direction of the shaft. The printing head units 1A and 1B respectively jet a black ink composition and a color ink composition for example.

The carriage 3 mounting the printing head units 1A and 1B is moved along the carriage shaft 5 by transmitting the driving force of a driving motor 6 to the carriage 3 via plural gears not shown and a timing belt 7. In the meantime, a platen 8 is provided to the body 4 of the apparatus along the carriage shaft 5 and a recording sheet S which is a recording medium such as paper fed by a paper feed roller not shown or others is wound on the platen 8 and carried.

As described above, according to the present invention, when the vibrating plate is deformed by applying voltage, stress concentration at the end of the piezoelectric active part and in the vicinity of the peripheral wall of the pressure generating chamber can be reduced by forming the piezoelectric active part so that an area including a part corresponding to the end of the piezoelectric active part is convex in the reverse direction to the piezoelectric element, thereby preventing a crack and others can be prevented from being caused. Driving voltage applied to the piezoelectric active part can be increased by further reducing stress.

What is claimed is:

1. An ink-jet printing head comprising a pressure generating chamber communicating with a nozzle aperture, a vibrating plate constituting a part of said pressure generating chamber and a piezoelectric element corresponding to said pressure generating chamber, the piezoelectric element comprising a lower electrode, a piezoelectric layer, and an upper electrode, wherein said vibrating plate in an area opposite to a vicinity of at least one end in the longitudinal direction of a piezoelectric active part of said piezoelectric element is convex to said pressure generating chamber, and said end of said piezoelectric active part is disposed at a position where said vibrating plate is convex.

2. An ink-jet printing head according to claim 1, wherein said vibrating plate in an area opposite to the vicinity of an end of said piezoelectric active part is convex to said pressure generating chamber when said piezoelectric element is driven, and said vibrating plate in an area opposite to the vicinity of the end of said piezoelectric active part is convex to said piezoelectric element when said piezoelectric element is not driven.

3. An ink-jet printing head according to claim 2, wherein stress in a direction in which said vibrating plate is compressed is applied to a vicinity of a surface on the side of said piezoelectric layer of said vibrating plate in an area opposite to the vicinity of the end of said piezoelectric active part when said piezoelectric element is driven.

4. An ink-jet printing head according to any one of claims 1 to 3, wherein a clearance between the end of said piezoelectric active part and a peripheral wall of said pressure generating chamber outside said piezoelectric active part is set to a range 0.3 to 5 times as wide as the width of said pressure generating chamber.

5. An ink-jet printing head according to any of claims 1 to 3, wherein the end of said piezoelectric active part is the end of said piezoelectric layer provided to an area opposite to said pressure generating chamber, and said lower electrode and said upper electrode effectively exist at the end of said piezoelectric layer.

6. An ink-jet printing head according to claim 5, wherein the end of said piezoelectric active part is disposed at ends of said piezoelectric layer and said upper electrode is patterned in an area opposite to said pressure generating chamber.

7. An ink-jet printing head according to any of claims 1 to 3, wherein a piezoelectric inactive part in which a piezoelectric layer not substantially driven exists extends from at least one end in the longitudinal direction of said piezoelectric active part.

8. An ink-jet printing head according to any of claims 1 to 3, wherein a piezoelectric inactive part in which the width of at least said piezoelectric layer is narrower than the width of said piezoelectric active part and said lower electrode and said upper electrode and said vibrating plate are continuously provided outside at least one end in the longitudinal direction of said piezoelectric active part.

9. An ink-jet printing head according to claim 7 or 8, wherein said piezoelectric inactive part is provided in at least one direction in the longitudinal direction of said piezoelectric active part and extends up to the peripheral wall of said pressure generating chamber.

10. An ink-jet printing head according to any of claims 1–3, 6 and 9, wherein an insulating layer is formed on the upper surface of said piezoelectric active part, and a contact part which connects said upper electrode and a lead electrode is formed in a contact hole formed in said insulating layer.

11. An ink-jet printing head according to claim 10, wherein said contact part is formed in an area which continues up to said piezoelectric inactive part on the peripheral wall of said pressure generating chamber.

12. An ink-jet printing head according to any of claims 1–3, 6, 9 and 11, wherein said pressure generating chamber is formed in a monocrystalline silicon substrate by anisotropic etching, and said vibrating plate and said piezoelectric element are formed by film forming technique and lithography.

13. An ink-jet printing apparatus having an ink-jet printing head comprising a piezoelectric element said piezoelectric element including a vibrating plate constituting a part of a pressure generating chamber communicating with a nozzle aperture, a lower electrode, a piezoelectric layer, and an upper electrode, wherein said vibrating plate in an area opposite to a vicinity of at least one end in the longitudinal direction of a piezoelectric active part which is an area in which said piezoelectric layer substantially drives said vibrating plate is convex on the reverse side to said piezoelectric element, and said end of said piezoelectric active part is disposed at a position where said vibrating plate is convex.

14. An ink-jet printing head according to claim 13, wherein said vibrating plate in an area opposite to the vicinity of an end of said piezoelectric active part is convex on the reverse side to said piezoelectric element when said piezoelectric element is driven, and said vibrating plate in an area opposite to the vicinity of the end of said piezoelectric active part is convex in a reverse direction when said piezoelectric element is not driven.

15. An ink-jet printing head according to claim 14, wherein stress in a direction in which said vibrating plate is compressed is applied to a vicinity of a surface on the side of said piezoelectric layer of said vibrating plate in an area opposite to the vicinity of the end of said piezoelectric active part when said piezoelectric element is driven.

16. An ink-jet printing head according to claim 13, wherein a clearance between the end of said piezoelectric active part and a peripheral wall of said pressure generating chamber outside said piezoelectric active part is set to a range 0.3 to 5 times as wide as the width of said pressure generating chamber.

17. An ink-jet printing head according to claim 13, wherein the end of said piezoelectric active part is the end of said piezoelectric layer provided to an area opposite to said pressure generating chamber, and said lower electrode and said upper electrode effectively exist at the end of said piezoelectric layer.

18. An ink-jet printing head according to claim 17, wherein the end of said piezoelectric active part disposed at ends of said piezoelectric layer and said upper electrode is patterned in an area opposite to said pressure generating chamber.

19. An ink-jet printing head according to claim 13, wherein a piezoelectric inactive part in which a piezoelectric layer not substantially driven exists extends from at least one end in the longitudinal direction of said piezoelectric active part.

20. An ink-jet printing head according to claim 13, wherein a piezoelectric inactive part in which the width of at least said piezoelectric layer is narrower than the width of said piezoelectric active part and said lower electrode and said upper electrode and said vibrating plate are continuously provided outside at least one end in the longitudinal direction of said piezoelectric active part.

21. An ink-jet printing head according to claim 19 or 20, wherein said piezoelectric inactive part is provided in at least one direction in the longitudinal direction of said piezoelectric active part and extends up to the peripheral wall of said pressure generating chamber.

22. An ink-jet printing head according to claim 13, further comprising an insulating layer formed on the upper surface of said piezoelectric active part, and a contact part which connects said upper electrode and a lead electrode is formed in a contact hole formed in said insulating layer.

23. An ink-jet printing head according to claim 22, wherein said contact part is formed in an area which continues up to said piezoelectric inactive part on the peripheral wall of said pressure generating chamber.

24. An ink-jet printing head according to claim 13, wherein said pressure generating chamber is formed in a monocrystalline silicon substrate by anisotropic etching, and said vibrating plate and said piezoelectric element are formed by film forming technique and lithography.

* * * * *